United States Patent [19]

Schintlmeister et al.

[11] Patent Number: 4,599,281

[45] Date of Patent: Jul. 8, 1986

[54] WEARING PART

[75] Inventors: Wilfried Schintlmeister; Wolfgang Wallgram, both of Tyrol, Austria

[73] Assignee: Schwartzkopf Development Corporation, New York, N.Y.

[21] Appl. No.: 452,445

[22] Filed: Dec. 23, 1982

[30] Foreign Application Priority Data

Dec. 24, 1981 [AT] Austria ..... 5557/81

[51] Int. Cl.[4] ..... B32B 9/00; B32B 19/00; B32B 15/04; B05D 3/06

[52] U.S. Cl. ..... 428/699; 428/469; 428/698; 428/701; 427/35

[58] Field of Search ..... 428/698, 699, 701, 469; 501/153; 420/528; 427/35

[56] References Cited

U.S. PATENT DOCUMENTS

| | | | |
|---|---|---|---|
| 3,746,557 | 7/1973 | Shimazaki et al. | 501/153 X |
| 3,837,896 | 9/1974 | Lindstrom et al. . | |
| 4,035,541 | 7/1977 | Smith et al. | 428/698 X |
| 4,055,451 | 10/1977 | Cochbain et al. | 428/698 X |
| 4,169,913 | 10/1979 | Kobayashi et al. | 428/698 X |
| 4,226,629 | 10/1980 | Tabuchi et al. | 501/153 X |
| 4,357,382 | 11/1982 | Lambert et al. | 428/698 X |
| 4,389,465 | 6/1983 | Nakai et al. | 428/698 |
| 4,447,263 | 5/1984 | Sugizawa et al. | 428/698 X |

FOREIGN PATENT DOCUMENTS

| | | | |
|---|---|---|---|
| 0154562 | 12/1980 | Japan | 428/698 |
| 2038370 | 7/1980 | United Kingdom. | |
| 2048960 | 12/1980 | United Kingdom. | |

*Primary Examiner*—George F. Lesmes
*Assistant Examiner*—Nancy A. B. Swisher
*Attorney, Agent, or Firm*—Morgan, Finnegan, Pine, Foley & Lee

[57] ABSTRACT

There is disclosed a wearing part comprising a basic body, a coating applied directly to the basic body or to a backing provided on the basic body and which coating consists of one or a plurality of layers of oxycarbides and/or oxynitrides and/or oxyborides and/or oxyboron nitrides and/or oxyboron carbon nitrides of the elements Ti, Zr, Hf, B, Si and Al and having an oxygen content in a range of from about 0.1 to about 5% by weight, alternating in each case with one or a plurality of layers of aluminum-boron mixed oxides having a boron content in a range of from about 0.01 to about 1% by weight. Compared to previously known wearing parts provided with multi-layer coatings a wearing part in accordance with the present invention exhibits significantly increased resistance to wear, as well as excellent adhesive strength, with respect to the hard-material coating, thus resulting in a substantially prolonged useful life.

10 Claims, No Drawings

WEARING PART

BACKGROUND OF THE INVENTION

The invention relates to a wearing part. More particularly the invention relates to a cutting insert made of hard metal and comprising a multi-layered coating of hard material having at least one layer that is an oxide layer, and which is employed in metal cutting work.

A wearing part of the type generally described above is disclosed in German Auslegeschrift 22 53 745, in which the inner layer adjoining the basic, hard, metal body is composed of one or a plurality of carbides and/or nitrides of the elements Ti, Zr, Hf, V, Nb, Ta, Cr, Mo, W, Si and/or B, and the outer layer is composed of one or a plurality of highly wear-resistant deposits of alumina and/or zirconia.

The disclosed wearing part is disadvantageous to the extent that cracks may form in the top layers of pure oxide and the oxide layers exhibit in many cases insufficient adhesive strength and, consequently, peel off. The friability of the oxide layer increases strongly as the thickness of the layer is increased and causes a highly disadvantageous change in the structure, so that as a practical matter, such layers on such wearing parts are limited to a comparatively very low thickness of only a few micrometers, i.e., a thicker layer does not bring any additional advantages. This, in turn, decisively limits the wear life of such wearing parts, such as, for example, of reversible cutting attachments for metal cutting.

German Offenlegungsschrift 23 17 447, which represents an application of addition or improvement to the above-mentioned German Auslegescrift 22 53 745, specifies a wearing part having an outer top layer which is composed of one or a plurality of deposits of ceramic oxides, and, in addition to the oxides disclosed in the main patent lists, oxides of the elements Si, B, Ca, Mg, Ti and/or Hf, generally including in the application also the formation of mixed oxides. No special mention is made of any individual mixed oxides.

To the extent to which experience has been gained with individual embodiments in practical application, the occurrence of cracks and the adhesive strength of the top oxide layers is not satisfactory in any of these cases.

A composite body preferably comprising a basic body made of hard metal is known from German Auslegeschrift 28 51 584, in which one or a plurality of layers composed of one or a plurality of carbides and/or nitrides of the elements Ti, Zr, Hf, V, Nb, Ta, Cr, Mo, W, Si and B are arranged on the basic body, and on which one or a plurality of layers, there is arranged one or a plurality of layers composed of a mixture of at least one oxide and at least one nitride and/or at least one oxynitride of the elements Cr, Al, Ca, Mg, Th, Sc, Y, La, Ti, Hf, V, Nb, Ta; with the nitrogen content of the outermost layer being in a range of from about 0.1 to about 30 atom-%, and preferably in a range of from about 0.2 to about 15 atom-%. The single example specifies the following structure of the layer on hard metal: TiC, 4 $\mu$m+$Al_2O_{2.8}N_{0.2}$, 2–3 $\mu$m.

Primarily hard-metal wearing parts are known and in practical commerical use in which the outer layer is composed of a relatively large number of alternating layers of Ti(C,N) and $Al_2(O,N)_3$. Such wearing parts are within the scope of German Auslegeschrift 29 17 348. However, with such composite bodies, the resistance to wear which can be achieved is not satisfactory for many cases of application. Furthermore, the excessive number of individual layers—the single example of German Auslegeschrift 29 17 348 specifies 38 individual layers—is not economical in terms of manufacture.

Therefore, it is the object of the present invention to provide a wearing part, in particular a cutting insert made of hard metal for metal cutting, which has a multi-layered coating of hard material, in which at least one layer is an oxide layer and which has an improved resistance to wear and which exhibits enhanced adhesive strength with respect to the hard material coating as compared to known wearing parts.

BRIEF STATEMENT OF THE INVENTION

In accordance with the invention, there is provided a wearing part comprising a basic body, a coating applied directly to the basic body or to a backing provided on the basic body and which coating consists in each case of one or a plurality of layers of oxycarbides and/or oxycarbon nitrides and/or oxynitrides and/or oxyborides and/or oxyboron nitrides and/or oxyboron carbon nitrides of the elements Ti, Zr, Hf, B, Si, Al and having an oxygen content in a range of from about 0.1 to about 5% by weight, alternating in each case with one or a plurality of layers of aluminum-boron mixed oxides having a boron content in a range of from about 0.01 to about 1% by weight.

As compared to known wearing parts provided wth multi-layered coatings, the wearing part of the invention exhibits significantly increased resistance to wear, as well as an excellent adhesive strength of the hard-material coating, resulting in a substantially prolonged useful life. These unexpectedly good properties are achieved by incorporating boron in the alumina layers combined with the incorporation of oxygen proportions in the intermediate layers of oxycarbide, oxycarbon nitride, oxynitride, oxyboride, oxyboron nitride and oxyboron carbon nitride. In particular, it is totally surprising that only the simultaneous incorporation of the oxygen proportions in the intermediate layers and of the boron in the alumina layers effects a substantial increase in the resistance to wear. This fact is supported by the examples set forth hereinbelow.

DESCRIPTION OF THE PREFERRED EMBODIMENTS

In accordance with the invention it is important that the oxygen and boron contents of the individual layers be maintained within the specified limits. The influence of the oxygen is practically no longer noticeable if it is below about 0.1% by weight. With oxygen contents exceeding the specified range, the hardness of the intermediate layers drops rapidly and no longer effects any increase in the resistance to wear of the layer structure according to the invention. Likewise, only a boron content in the alumina within the limits according to the invention will lead to an abrupt increase in the resistance to wear. Actually, it was not to be expected that the addition of boron to alumina would result in an increase of the resistance to wear to begin with, since pure boron is very soft and totally unsuitable as a layer protecting against wear. In addition, a boron content within the limits mentioned generates less dust in the coating booth when the aluminum-boron mixed oxide layer is deposited, which means it effects less dust also on the surface of the material being coated, which in turn, causes fewer flaws in the layer and leads to more uniform layers.

In certain cases of application, it is useful to provide a backing layer between the basic body and the coating according to the invention. The backing has a single or multi-layer structure preferably composed of one or a plurality of carbides, nitrides, carbon nitrides, borides or boron nitrides of the elements of Groups IV to VI of the Periodic System.

Furthermore, it is advantageous in certain cases of application to apply to the basic body of hard metal or to the backing layer one single layer of titanium oxycarbon nitride and/or titanium oxynitride with a layer thickness of from about 0.05 to about 1 μm and to subsequently apply thereto one single aluminum-boron mixed oxide layer with a layer thickness of from about 2 to about 10 μm.

According to a particularly preferred embodiment of the invention, the basic body of hard metal or the backing layer is provided with a coating consisting of a layer of titanium oxycarbon nitride and/or titanium oxynitride with a layer thickness of from about 0.1 to about 1 μm, to which there are subsequently applied from 2 to 8 aluminum-boron mixed oxide layers, each layer having a thickness of from about 0.3 to about 2 μm, in each case alternating with from 1 to 7 layers of titanium oxycarbon nitride and/or titanium oxynitride, each layer having a thickness from about 0.05 to about 0.5 μm. The titanium oxycarbon nitride and/or titanium oxynitride layers have an oxygen content of preferably from about 0.5 to about 3% by weight, whereas the aluminum-boron mixed oxide layers have a boron content preferably in the range of from about 0.2 to about 2% by weight.

As compared to a layer structure which, according to the invention, contains only one aluminum-boron mixed oxide layer, it is in particular the multi-layered structure of the invention which further increases the toughness of the coating and, as well, exhibits excellent adhesive strength of the individual layers, thus leading to an unexpected increase in resistance to wear under impact stressing of the wearing part.

A particularly preferred backing layer comprises the following layer sequence disposed on a basic body of hard metal; titanium carbide and/or titanium carbon nitride and/or titanium nitride with a total layer thickness of from about 1 to about 10 μm.

Furthermore, it may be advantageous if the aluminum-boron mixed oxides partially contain titanium, zirconium, hafnium, niobium, chromium and/or magnesium oxides. In addition, the mixed oxides also may have a nitrogen content of from about 0.2 to about 4 atom-%.

The wearing part according to the invention is preferably coated with the hard material by using the CVD-process, that is the chemical vapor deposition process, whereby the chemical composition of the individual layers is fixed by adjusting the mixing ratios of the reaction gases accordingly.

Another preferred process for producing the wearing part of the present invention comprises producing the individual layers with the respective chemical compositions both by depositing according to the CVD-process, that is the chemical vapor deposition process, and interdiffusion between adjacent layers.

In particular, the oxygen proportions may be incorporated in the layers of oxycarbide, oxycarbon nitride, oxynitride, oxyboron nitride, oxyboride and/or oxyboron carbon nitride both by adjusting the composition of the gas mixture accordingly, which mixture may contain, for example, $CO_2$, steam, air, $O_2$ or other oxidizing gases, and interdiffusion from the adjacent aluminum-boron mixed oxide layers. The interdiffusion may be carried out, for example, by a temperature treatment between or after the individual coating steps at a temperature above the coating temperature, or during the application of the aluminum-boron mixed oxide layers by increasing the supply of oxygen in the gas mixture.

THE EXAMPLES

In order to illustrate the present invention more fully, the following illustrative examples are set forth. It is to be understood that the examples are illustrative and not limitative.

EXAMPLE 1

Coatings in five different variations of layer structure as specified in the following Table were applied to reversible cutting plates made of hard metal of grade of grade U10T and having a composition of 6% Co, 5% TiC, 5% (TaC+NbC), 84% WC, conforming to ISO application group M10 and form SPGN 120308 EN. In accordance with the coating process employed, the reversible cutting plates were cleaned, installed in the coating chamber of a prototype plant of applicant, heated to the coating temperature under protective gas and coated under the coating conditions specified in the following Table.

Variations 4 and 5 were provided with a layer structure according to the invention. These variations were compared in a machining or cutting test with the variations 1 to 3 all of which had a layer structure different from that of the present invention and in one case a known layer structure.

All variations comprised a backing consisting of 2 μm titanium carbide followed by 2 μm titanium carbon nitride (with approximately 40% TiC and 60% TiN proportions). Nitrogen was used as the carrier gas for variations 1 to 4, which means that the layer of alumina or aluminum-boron mixed oxides contained about 3 atom-% nitrogen. For variation 5, the aluminum-boron mixed oxide layer was free of nitrogen.

Layer structures:

| Variation | TiC | 1. Ti(C, N) | 2. Ti(C, N) | Ti(C, N, O) | $Al_2O_3$ | Al—B mixed oxide with 0.1% by wt. boron |
|---|---|---|---|---|---|---|
| 1 | about 2 μm | about 2 μm | about 0.4 μm | — | 2.5-3.5 μm | — |
| 2 | about 2 μm | about 2 μm | about 0.4 μm | — | — | about 3 μm |
| 3 | 2 μm | 2 μm | — | about 0.4 μm | about 3 μm | — |
| 4 | 2 μm | 2 μm | — | about 0.4 μm | — | about 3 μm |
| 5 | 2 μm | 2 μm | — | about 0.4 μm | — | about 3 μm |

Coating conditions:

Gas pressure in all cases; atmospheric pressure (about 1 bar absolute)

-continued

| TiC-layer | | 1. Ti(C, N)-layer |
|---|---|---|
| Gas mixture: | 84 vol % $H_2$ | 81 8 vol % $H_2$ |
| | 3.2 vol % $TiCl_4$ | 3.2 vol % $TiCl_4$ |
| | 12.8 vol % $CH_4$ | 10 vol % $N_2$ |
| Duration: | 17 minutes | 25 minutes |
| Temperature | 1040° C. | 1040° C. |
| **2. Ti(C, N)-layer** | | **Ti(C, N, O)-layer** |
| Gas mixture: | 66 vol % $H_2$ | 65.95 vol % $H_2$ |
| | 3 vol % $TiCl_4$ | 3 vol % $TiCl_4$ |
| | 16 vol % $N_2$ | 16 vol % $N_2$ |
| | 11 vol % Ar | 4 vol % $CH_4$ |
| | 4 vol % $CH_4$ | 11 vol % Ar |
| | | 0.05 vol % $CO_2$ |
| Duration: | 16 minutes | 16 minutes |
| Temperature: | 1060° C. | 1060° C. |

$Al_2O_3$-layer or Al—B mixed oxide layer:

| Gas mixture with nitrogen: (variations 1–4) | Gas mixture without nitrogen: (variation 5) |
|---|---|
| 13.25 vol % $H_2$ | 13.25 vol % $H_2$ |
| 58 vol % $N_2$ | 81 vol % Ar |
| 23 vol % Ar | 1.6 vol % $AlCl_3$ |
| 1.6 vol % $AlCl_3$ | |
| 4 vol % $CO_2$ | 4 vol % $CO_2$ |
| Variations 2, 4 and 5 | 0.15 vol % $BCl_3$ |
| Variations 1 and 3 | 0 vol % $BCl_3$ and 13.4 vol % $H_2$ |
| Duration: 160 minutes | |
| Temperature: 1060° C. | |

Cutting test

Turning tests were carried out on 2 shafts made of different materials under different cutting conditions using the coated reversible cutting plates with an HDP 7225 tool:

1. Material: structural steel, material No. 1.1231
   Composition:
   0.72% C
   0.28% Si
   0.79% Mn
   0.015% P
   0.011% S,
   balance Fe, refined to 1000 N/mm$^2$
   Cutting rate: v=180 m/min
   Feed rate: s=0.42 mm/revolution
   Cutting depth: a=2 mm
2. Material: gray (cast) iron
   Recommended composition values:
   3–3.5% C
   0.4–0.8% Si
   0.2–0.5% Mn, balance Fe
   Hardness: 215 HB
   Cutting rate: v=80 m/min
   Feed rate: s=0.28 mm/revolution
   Cutting depth: a=2 mm The wear mark width $v_B$ of the flank wear was measured in each case after a turning time of 5 minutes.

| Variation | Turning of structural steel: end of wear life after turning | Turning of cast iron: $v_B$ after 5 minutes |
|---|---|---|
| 1 | 18 minutes | 0.16 mm |
| 2 | 18.5 minutes | 0.17 mm |
| 3 | 17.5 minutes | 0.18 mm |
| 4 | 23 minutes | 0.11 mm |
| 5 | 24.5 minutes | 0.10 mm |

The wear life was ended for all variations due to cratering.

A comparison between the wear results shows that a noticeable increase in the resistance to wear is achieved only with the layer structures of variations 4 and 5 according to the invention (where a boron proportion is present in the alumina layer simultaneously with an oxygen proportion in the Ti(C,N)-layer) as compared to variation 1, which approximately has the layer structure of a material currently available on the market. On the other hand, the alternative incorporation of boron in the alumina layer (variation 2) or of oxygen in the Ti(C,N)-layer yields no significant increase in the wear resistance as compared to variation 1.

The comparison between variations 4 and 5 shows that a defined proportion of nitrogen in the aluminum-boron mixed oxide layer, which is formed, for example, if nitrogen is used as the carrier gas in the coating process, has an only insignificant influence on the resistance to wear values.

EXAMPLE 2

In contrast to EXAMPLE 1, the single-layered $Al_2O_3$ or aluminum-boron mixed oxide layer is replaced by 4 layers which are connected to each other via 3 intermediate Ti(C,N)-layers or 3 Ti(C,N,O)-layers, respectively.

Argon was the carrier gas used for variations 1 to 4, which means that the aluminum-boron mixed oxide layer was free of nitrogen.

In connection with variation 5, the mixed-oxide layer contained 3 atom-% nitrogen, because $N_2$ was used as the carrier gas.

Layer structures

-continued

| Variation | TiC | 1. Ti(C, N) | 2. Ti(C, N) | Ti(C, N, O) with abt. 1 wt. % O | $Al_2O_3$ | Al—B-mixed oxide with 0.1% by wt. boron | Intermediate layers |
|---|---|---|---|---|---|---|---|
| 1 | 2 μm | 2 μm | 0.5 μm | — | 4 × 0.8 μm | — | 3 × 0.2 μm Ti(C, N) |
| 2 | 2 μm | 2 μm | 0.5 μm | — | — | 4.0 × 0.9 μm | 3 × 0.2 μm Ti(C, N) |
| 3 | 2 μm | 2 μm | — | 0.3 μm | 4 × 0.8 μm | | 3 × 0.15 μm Ti(C, N, O) |
| 4 | 2 μm | 2 μm | — | 0.3 μm | — | 4.0 × 0.9 μm | 3 × 0.15 μm Ti(C, N, O) |
| 5 | 2 μm | 2 μm | — | 0.3 μm | — | 4.0 × 0.7 μm | 3 × 0.15 μm (Ti(C, N, O)) |

Coating conditions:

Gas pressure in all cases: atmospheric pressure (about 1 bar absolute)

| | TiC-layer | 1. Ti(C, N)-layer |
|---|---|---|
| Gas mixture: | 84 vol % $H_2$<br>3.2 vol % $TiCl_4$<br>12.8 vol % $CH_4$ | 81.8 vol % $H_2$<br>3,2 vol % $TiCl_4$<br>10 vol % $N_2$<br>5 vol % $CH_4$ |
| Duration: | 17 minutes | 25 minutes |
| Temperature: | 1040° C. | 1040° C. |

| | 2. Ti(C, N)-layer | Ti(C, N, O)-layer |
|---|---|---|
| Gas mixture: | 66 vol % $H_2$<br>3 vol % $TiCl_4$<br>16 vol % $N_2$<br>11 vol % Ar<br>4 vol % $CH_4$ | 65.95 vol % $H_2$<br>3 vol % $TiCl_4$<br>16 vol % $N_2$<br>11 vol % Ar<br>4 vol % $CH_4$<br>0.05 vol % $CO_2$ |
| Duration: | 16 minutes | 16 minutes |
| Temperature: | 1060° C. | 1060° C. |

$Al_2O_3$-layers or aluminum-boron mixed oxide layers

| Gas mixture with nitrogen: (variation 5) | Gas mixture without nitrogen: (variations 1–4) |
|---|---|
| 13.25 vol % $H_2$<br>58 vol % $N_2$<br>23 vol % Ar<br>1.6 vol % $AlCl_3$<br>4 vol % $CO_2$ | 13.25 vol % $H_2$<br>81 vol % $N_2$<br>1.6 vol % $AlCl_3$<br>4 vol % $CO_2$ |
| Variations 2, 4 and 5 | 0.15 vol % $BCl_3$ |
| Variations 1 and 3 | 0 vol % $BCl_3$ and 13.4 vol % $H_2$ |
| Duration: 40 minutes/layer | |
| Temperature: 1060° C. | |

Ti(C,N)-intermediate layers

Coating temperature and gas composition as specified for 2nd Ti(C,N)-layer

Duration: 8 minutes/layer

Ti(C,N,O)-intermediate layers

Coating temperature and gas composition as specified above.

Duration: 8 minutes/layer

Cutting test

Turning tests were carried out with the coated reversible cutting plates using a shaft made of structural steel and cutting conditions as specified in EXAMPLE 1.

| Variation | End of useful (wear) life after: |
|---|---|
| 1 | 26 minutes |
| 2 | 25.5 minutes |
| 3 | 27 minutes |
| 4 | 36 minutes |
| 5 | 33 minutes |

The end of the useful life was caused in each case by the limit of still-acceptable cratering.

The comparison between EXAMPLES 1 and 2 shows that as compared to the single-layer structure according to EXAMPLE 1, a further increase in the resistance to wear can be achieved under the given cutting conditions and with an about equal total layer thickness with the multi-layer structure of the alumina and aluminum-boron mixed oxide layers as defined in EXAMPLE 2. The increase in the resistance to wear in the layer structure according to the invention (variations 4 and 5) in significantly higher than the one with the layer structure according to variations 1 to 3.

EXAMPLE 3

A layer of $Ti(C_{0.6},N_{0.4})$ was deposited as backing layer on reversible cutting plates of the same type as specified in EXAMPLE 1, and a TiN-layer was then applied (deposited) to said backing. Additional layers were applied in 2 variations; variation 2 represents the layer structure according to the invention. In contrast to the preceding EXAMPLES, the coating process was carried out at underpressure. The wear resistances of the individual variations were compared again in a cutting test.

| Layer structure: | |
|---|---|
| Variation 1: | 2 μm $Ti(C_{0.6}, N_{0.4})$<br>1.5 μm TiN<br>1.5 μm $Al_2O_3$<br>0.5 μm TiN |

-continued

| | |
|---|---|
| | 1.5 μm $Al_2O_3$ |
| Variation 2: | 2 μm $Ti(C_{0.6}, N_{0.4})$ |
| | 1 μm TiN |
| | abt. 0.5 μm Ti(N, B, O) |
| | 1.5 μm aluminum-boron mixed oxide |
| | 0.5 μm Ti(N, B, O) |
| | 1.5 μm aluminum-boron mixed oxide |

Coating conditions:

$Ti(C_{0.6}, N_{0.4})$-layer: Temperature: 1020° C.

Pressure: 5 k Pa $5{,}1 \cdot 10^{-2} \frac{kp}{cm^2}$

Gas mixture: 83 vol % $H_2$, 8 vol % $N_2$, 4 vol % $CH_4$, 5 vol % $TiCl_4$

Duration: 130 minutes

TiN-layer: Temperature: 1020° C.

Pressure: 6 k Pa $6{,}12 \cdot 10^{-2} \frac{kp}{cm^2}$

Gas mixture: 65 vol % $H_2$, 32 vol % $N_2$, 7 vol % $TiCl_4$

Duration: Variation 1: 93 minutes
Variation 2: 62 minutes

Ti(N, B, O)-layers: Temperature: 1020° C.

Pressure: 4 k Pa $4{,}08 \cdot 10^{-2} \frac{kp}{cm^2}$

Gas mixture: 60.8 vol % $H_2$, 27 vol % $N_2$, 5 vol % $BCl_3$, 7 vol % $TiCl_4$, 0.2 vol % $CO_2$ Duration: 35 minutes $Al_2O_3$-layers: Temperature: 1020° C.

Pressure: 4 k Pa $4{,}08 \cdot 10^{-2} \frac{kp}{cm^2}$

Gas mixture: 76.8 vol % $H_2$, 4.0 vol % $CO_2$, 16 vol % CO, 3.2 vol % $AlCl_3$ Duration: 180 minutes/layer Aluminum-boron mixed oxide layers: Temperature: 1020° C.

Pressure: 4 k Pa $4{,}08 \cdot 10^{-2} \frac{kp}{cm^2}$

Gas mixture: 76.5 vol % $H_2$, 4.0 vol % $CO_2$, 16 vol % CO, 3.2 vol % $AlCl_3$, 0.3 vol % $BCl_3$ Duration: 180 minutes/layer Turning tests were carried out with the coated cutting plates on structural steel under the cutting conditions specified in EXAMPLE 1 and turning tests on gray (cast) iron under the following cutting conditions:

Material: Gray cast iron—composition as defined in EXAMPLE 1
Hardness: 205 HB
Cutting rate v: 80 m/min
Feed rate s: 0.28 mm/revolution
Cutting depth a: 2 mm

| Variation | Structural steel: End of useful life after: | Gray (cast) iron: Wear mark width $v_B$ after 10 minutes: |
|---|---|---|
| 1 | 21 minutes | 0.28 mm |
| 2 | 28 minutes | 0.15 mm |

The comparison between EXAMPLE 1 and EXAMPLES 2 and 3 shows that no significant difference exists with respect to the quality of the wear parts with the different coatings irrespective of whether said parts were coated at atmospheric pressure or in the under pressure.

EXAMPLE 4

A multi-layer structure was applied directly to the hard metal of reversible cutting plates (of the same type as in the preceding EXAMPLES) without a backing layer; the plates were coated under pressure (variation 2). The layer structure was compared with a multi-layer coating structure different from the one of the invention, but also applied without using a backing (variation 1).

Layer structure:

| Variation 1: | Variation 2: |
|---|---|
| 0.5 μm $Ti(C_{0.6}, N_{0.4})$ | 0.5 μm Ti(C, N, O) |
| 0.8 μm $Al_2O_3$ | 0.8 μm aluminum-boron mixed oxide |
| 0.3 μm Ti(C, N) | 0.2 μm Ti(C, N, O) |
| 0.8 μm $Al_2O_3$ | 0.8 μm aluminum-boron mixed oxide |
| 0.3 μm Ti(C, N) | 0.2 μm Ti(C, N, O) |
| 0.8 μm $Al_2O_3$ | 0.8 μm aluminum-boron mixed oxide |
| 0.3 μm Ti(C, N) | 0.2 μm Ti(C, N, O) |
| 0.8 μm $Al_2O_3$ | 0.8 μm aluminum-boron mixed oxide |
| 0.3 μm Ti(C, N) | 0.2 μm Ti(C, N, O) |
| 0.8 μm $Al_2O_3$ | 0.8 μm aluminum-boron mixed oxide |

Oxygen content of the Ti(C, N, O)-layers of variation 2 about 2% by weight.

Coating conditions:

$Ti(C_{0.6}, N_{0.4})$-layers:

Gas mixture: 83 vol % $H_2$, 8 vol % $N_2$, 4 vol % $CH_4$, 5 vol % $TiCl_4$

Temperature: 1020° C. Duration: backing (layer): 32 minutes

Pressure: 5 k Pa $5{,}1 \cdot 10^{-2} \frac{kp}{cm^2}$ intermediate layers: 20 min/layer Ti(C, N, O)-layers:

Gas mixture: 82.9 vol % $H_2$, 8 vol % $N_2$, 4 vol % $CH_4$, 5 vol % $TiCl_4$, 0.1 vol % $CO_2$ Temperature: 1020° C.

Pressure: 1 k Pa $1{,}02 \cdot 10^{-2} \frac{kp}{cm^2}$

Duration: backing (layer): 45 minutes
intermediate layers: 18 minutes/layer $Al_2O_3$-layers:

Gas mixture: 25 vol % $H_2$, 6 vol % $CO_2$, 66 vol % Ar, 3 vol % $AlCl_3$

Temperature: 1020° C.

Pressure: 4 k Pa $4{,}08 \cdot 10^{-2} \frac{kp}{cm^2}$

Duration: 65 minutes/layer

-continued

| Aluminum-boron layers (mixed oxide layers): | |
|---|---|
| Gas mixture | vol % $H_2$ |
| | 6 vol % $CO_2$ |
| | 65.6 vol % Ar |
| | 3 vol % $AlCl_3$ |
| | 0.4 vol % $BCl_3$ |
| Temperature: | 1020° C. |
| Pressure: | 4 k Pa $4{,}08 \cdot 10^{-2} \frac{kp}{cm^2}$ |
| Duration: | 65 minutes/layer |

Cutting test

Turning tests were carried out on a structural steel shaft (0.6% C, strength 750 N/mm$^2$) under the following cutting conditions:

Cutting rate v=200 m/min

Feed rate s=0.41 mm/revolution

Cutting depth a=2 mm

The end of the useful life was caused for both variations by cratering. For variation 1, the end of the useful life was reached after 32 minutes, and for the variation according to the invention (variation 2) after 41 minutes.

In the EXAMPLES, the basic body was composed of hard metal. However, the present invention is not limited to basic bodies made of hard metal. The layer structure according to the invention leads to an unexpectedly high increase in the resistance to wear also with other basic body materials such as, for example, high-speed tool steel, stellite or other heat-resistant alloys. Likewise, the invention is not limited to tools used in metal cutting, but also covers tools for noncutting working, such as drawing dies and the like, as well as tools which are mainly subjected to eroding wear, for example, rock drills.

What is claimed is:

1. A wearing part comprising a hard-metal cutting insert for metal cutting having a basic body and a multilayered coating of hard material at least one layer of which is an oxide layer, said coating consisting of one or a plurality of layers of hard material selected from the group consisting of oxycarbides, oxycarbon nitrides, oxynitrides, oxyborides, oxyboron nitrides and oxyboron carbon nitrides of the elements Ti, Zr, Hf, B, Si and Al and mixtures thereof and having an oxygen content in a range of from about 0.1 to about 5% by weight, said layers alternating with one or a plurality of layers each comprised of aluminum-boron mixed oxide having a boron content in a range of from about 0.01 to about 1% by weight.

2. The wearing part according to claim 1, including a backing which has a single-layer or multi-layer structure composed of one or a plurality of materials selected from the group consisting of carbides, nitrides, carbon nitrides, borides and boron nitrides of the elements of Groups IV to VI of the Periodic System.

3. The wearing part according to claim 1, wherein a layer of hard material selected from the group consisting of titanium oxycarbon nitride and titanium oxynitride and mixtures thereof said layer having a thickness of from 0.05 to 1 μm and subsequently an aluminum-boron mixed oxide layer having a layer thickness of from about 2 to about 10 μm are applied to the basic body directly or to a backing layer on said basic body.

4. The wearing part according to claim 1, wherein a layer of hard material selected from the group consisting of titanium oxycarbon nitride and titanium oxynitride and mixtures thereof having a layer thickness of from about 0.1 to about 1 μm is applied to the basic body directly or to a backing layer on said basic body and subsequently 2 to 8 aluminum-boron mixed oxide layers having layer thicknesses of about 0.3 to about 2 μm alternating with 1 to 7 layers of hard material selected from the group consisting of titanium oxycarbon nitride and titanium oxynitride and mixtures thereof having layer thicknesses of about 0.05 to about 0.05 μm are applied thereto.

5. The wearing part according to claims 3 and 4, wherein the layers of hard material selected from the group consisting of titanium oxycarbon nitride and titanium oxynitride and mixtures thereof have an oxygen content of from about 0.5 to about 3% by weight.

6. The wearing part according to claim 3, wherein the aluminum-boron mixed oxide layers have a boron content of from about 0.04 to about 0.4% by weight.

7. The wearing part according to claim 1, wherein the backing layer has a layer sequence of titanium carbide, and or titanium carbon nitride and/or titanium nitride and mixtures thereof having a total layer thickness in a range of from about 1 to about 8 μm, based on the basic body.

8. The wearing part according to claim 1, wherein the mixed oxides have a nitrogen content in a range of from about 0.2 to about 4 atom-%.

9. The wearing part according to claim 1 produced by the method comprising depositing the hard material coating by chemical vapor deposition while adjusting the mixing ratios of the reaction gases to fix the chemical composition of the individual layers of said hard material.

10. The wearing part according to claim 1 produced by the method comprising depositing the hard material coating by chemical vapor deposition and fixing the chemical composition of the individual layers of said hard material, both by adjusting the mixing ratios of the reaction gases for chemical vapor deposition and by arranging for an interdiffusion process between adjacent layers.

* * * * *